US007918413B2

(12) United States Patent
Odderson

(10) Patent No.: US 7,918,413 B2
(45) Date of Patent: Apr. 5, 2011

(54) HOLIDAY LIGHTS STRING STORAGE DEVICE AND METHOD

(76) Inventor: Ib R. Odderson, Kirkland, WA (US)

( * ) Notice: Subject to any disclaimer, the term of this patent is extended or adjusted under 35 U.S.C. 154(b) by 400 days.

(21) Appl. No.: 12/008,393

(22) Filed: Jan. 9, 2008

(65) Prior Publication Data

US 2008/0164362 A1 Jul. 10, 2008

Related U.S. Application Data

(60) Provisional application No. 60/879,648, filed on Jan. 9, 2007.

(51) Int. Cl.
*B65H 75/30* (2006.01)
*B65H 75/38* (2006.01)

(52) U.S. Cl. ..... 242/395; 242/395.1; 242/405.3; 242/388.6; 206/418; 206/419; 206/420; 206/421; 53/430

(58) Field of Classification Search ..... 242/395, 242/395.1, 405.3, 388.6; 206/418, 419, 420, 206/421; 53/430; 439/501, 4; 362/249.19
See application file for complete search history.

(56) References Cited

U.S. PATENT DOCUMENTS 2,438,089 A * 3/1948 Carson ..... 53/410
2,872,032 A * 2/1959 West ..... 206/419
3,690,087 A * 9/1972 Jacobsen ..... 53/397
5,598,985 A * 2/1997 Winesett ..... 242/395
5,661,953 A * 9/1997 Jolley ..... 53/430
5,676,250 A 10/1997 Walters ..... 206/419
5,868,334 A * 2/1999 Cedillo ..... 242/405.3
5,992,627 A * 11/1999 Lai ..... 206/418
6,076,759 A * 6/2000 Simonson ..... 242/405.3
6,398,148 B1 * 6/2002 Snow ..... 242/395.1
6,874,722 B2 * 4/2005 Wei ..... 242/378
7,004,319 B2 * 2/2006 Knight et al. ..... 206/420
7,198,153 B2 * 4/2007 Shaffer ..... 206/419
2004/0118726 A1 * 6/2004 Meyer ..... 206/419

* cited by examiner

*Primary Examiner* — Terrell McKinnon
*Assistant Examiner* — Michael McDuffie
(74) *Attorney, Agent, or Firm* — Dean A. Craine

(57) ABSTRACT

A string of holiday lights and storage device and method that includes a spool made of two coaxially aligned, circular plates spaced apart by at least a transversely aligned first axle. The axle is attached to a handle located outside the circular plate which allows the axle to be manually rotated. Located parallel to the first axle is a second axle located between the circular plates or two lateral extending arms. Disposed between the two axles is a wide, flexible support strap designed to be wound in opposite directions onto each axle. During use, the end of a string of holiday lights is inserted against the inside surface of the support strap. As the strap is wound onto the first axle, the string of lights is also automatically wound into the first axle so that it is held in position against the outer surface of the axle.

2 Claims, 2 Drawing Sheets

HOLIDAY LIGHTS STRING STORAGE DEVICE AND METHOD

This is a utility patent application which claims benefit of U.S. Provisional Application No. 60/879,648, filed on Jan. 9, 2007.

BACKGROUND OF THE INVENTION

1. Field of the Invention

This invention relates to devices used to store holiday light strings, and more particularly, to such devices that hold branched or non-branched holiday light strings in a compact, easy to unravel configuration.

2. Description of the Related Art

Ornamental holiday light strings are very popular because they can be easily hung over a tree, from gutters, or around windows and doors. Typical string lights consist of several wires wrapped together to form a main cord 12-20 feet in length with a plurality of small lights evenly spaced apart along the entire length of the main cord.

Recently, icicle-style, branched holiday light strings have become popular. Such lights typically include a main cord with a plurality short wire branches approximately 6 to 12 inches in length that extends laterally from the main cord. A plurality of small light bulbs are evenly spaced apart along each wire branch.

Holiday light strings are only used two to three weeks each year during the Christmas and New Year holidays. Normally, the holiday light strings are sold in flimsy cardboard container that can be easily torn and are difficult to reuse. When the light strings are not in use, they are often rolled up and stored in a large plastic container with other light strings where they become tangled together. When the light strings are removed from the plastic container the next holiday season, they must be untangled. As the strings are being untangled, the wire branches and the individual light bulbs may be broken.

What is needed is a holiday light strings storage device designed to allow holiday string lights to be easily stored in a protective, untangled manner.

SUMMARY OF THE INVENTION

It is an object of the present invention to a holiday lights string storage device.

It is an object of the present invention to provide such a device that allows either branched or non-branched holiday lights string to be easily stored by winding and unwinding it from a spool.

It is another object of the present invention to provide such a device that protects the string's main cord, the wire branches and the light bulbs so they to not become tangled and broken.

These and other objects of the invention are met by the holiday lights string storage device disclosed herein that includes a storage spool with two-coaxially aligned, circular plates. In the first embodiment, two rotating axles are transversely aligned on opposite sides of the central axis of the two, coaxially aligned, circular plates. Each axle is attached to a handle which allows the axle to be manually rotated. In a second embodiment, one axle is transversely aligned between the two circular plates with a second axle attached to two parallel arms that extend laterally from the two plates.

Disposed between the two axles is a wide flexible support strap designed to be wound onto each axle. During use, the support strap is wound onto one axle and is automatically unwound from the other axle. An optional strap tightening means is provided to keep the strap taut when wound and unwound from the two axles.

When winding a holiday lights string onto the device, the end of the string is placed against the inside surface of the support strap so that when the support strap is wound onto an axle, it is held in position around the axle. As the string's main cord is feed onto the support strap, the lights and wire branches are manually laterally spread out over the inside surface of the support strap. The handle attached to the axle is then slowly rotated so that the main cord and the branches are continuously pulled and wound in stacked layers onto the axle. A means for locking the handles in place on the device is then used to prevent the axle from unwinding. To unwind the lights from the device, the means for locking is deactivated and the handle attached to the empty axle is rotated thereby slowly winding the support strap thereon. As the handle is rotated, the string of lights falls from the support strap and are ready for installation.

DESCRIPTION OF THE PREFERRED EMBODIMENT(S)

Figure 1:
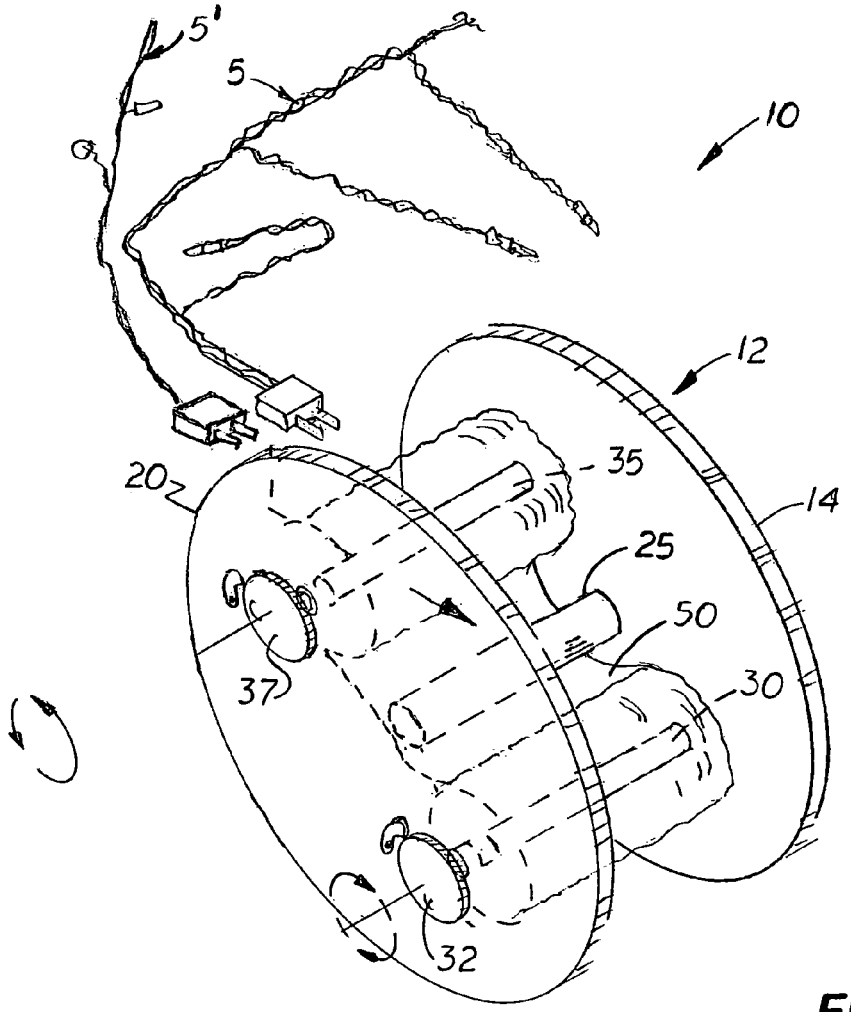
FIG. 1 is a perspective view of a holiday lights string storage device.
Figure 2:
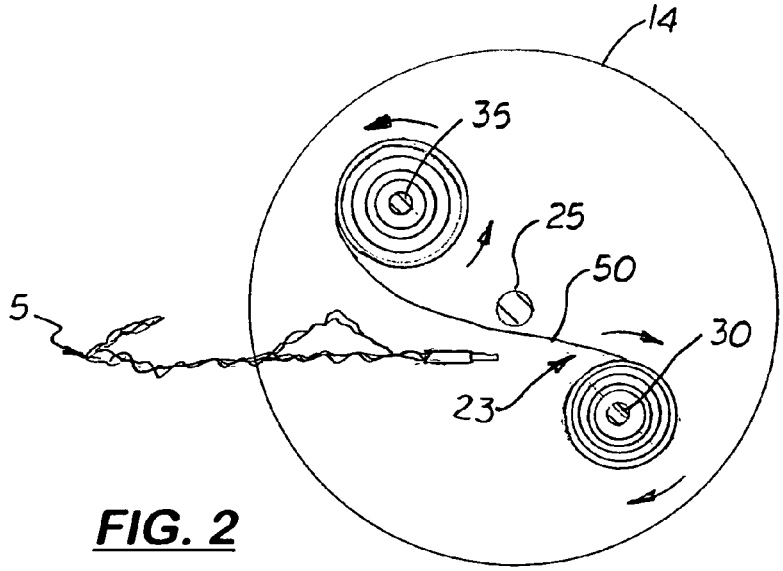
FIG. 2 is a side elevational view of the device.

Referring to the accompanying Figs., there is shown a holiday lights string storage device 10 disclosed herein that includes a branched or non-brached holiday string of lights 5, 5', respectively, and a storage spool 12 design to safely and conveniently store the string of lights 5, 5'. The spool 12 includes two coaxially aligned, circular plates 14, 20. In the first embodiment shown in FIGS. 1 and 2, the two circular plates 14, 20 are separated by an optional strap tightening bar 25 and two rotating axles 30, 35. Each axle 30, 35 extends transversely between the inside surfaces of the two plates 14, 20. Each axle 30, 35 has an attached to a handle 32, 37, respectively, that extends through the adjacent plate 20 which allows each axle 30, 35 to be manually rotated in clockwise or counter-clockwise directions. In the first embodiment, the strap tightening bar 25 is a fixed structure, coaxially aligned with the two circular plates 14, 20.

Disposed between the two axles 30, 35 is a wide flexible support strap 50. The opposite ends of the support strap 50 are securely attached to the two axles 30, 35 so that support strap 50 may be wound in opposite directions on each axle. In the preferred embodiment, the strap 50 is approximately the same width as the distance between the two circular plates 14, 20. The strap 50 extends across one side of the strap tightening bar 25 thereby 'flattening' or changing the angle of the section of the strap 50 just before it is wound onto the adjacent axle. By 'flattening' or changing the angle of the section of the strap 50, the gap 23 (See FIG. 2) between the incoming section of the strap 50 and the adjacent axle 30 is narrowed which enables the end of the string of lights 5 to be held as the string of lights 5 is initially wound onto the axle 30. Once the end of the string of lights 5 is grasped by the strap 50 and the axle 30, the handle is rotated to wind the strap 50 and string of lights 5 onto the axle 30.

Figure 3:
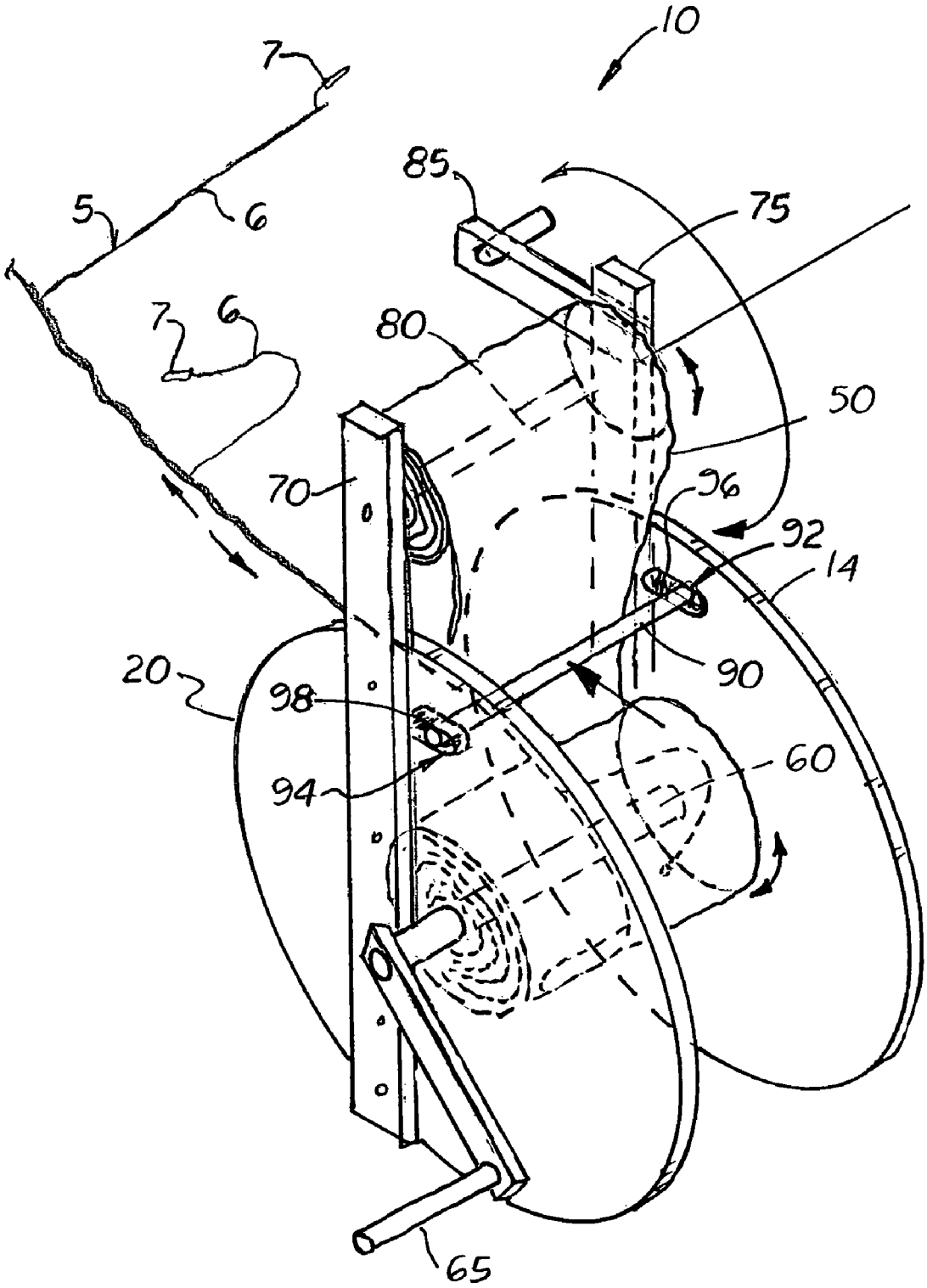
FIG. 3 is a perspective view of an alternative embodiment of the device.

In a second embodiment shown in FIG. 3, the device 10 includes two coaxially aligned circular plates 14, 20, also spaced apart by a central located rotating axle 60. Attached to the axle 60 is a handle 65 that allows the user to manually rotate the axle 60. Attached to the outside surfaces of the two circular plates 14, 20 are two laterally extending, parallel arms 70, 75. The arms 70, 75 are approximately the same length and are sufficiently rigid to hold a second rotating axle 80 located adjacent to the two circular plates 14, 20. A handle 85 is attached to the second axle 80 enabling the second axle 80 to be manually rotated. Mounted between the two circular plates 14, 20 is an adjustable strap tension bar 90 designed to apply a force against the support strap 50. In this embodiment, springs 96, 98 are mounted on the ends of the tension bar 90 and the slots 92, 94 formed on the two circular plates 14, 20, respectively, which bias the strap tension bar 90 towards the support strap 50. It should be understood, that the adjustable strap tension bar 90 may also be used on first embodiment, shown in FIGS. 1 and 2.

Each circular plate 14, 20 are made of rigid plastic approximately 10 inches in diameter and ⅜ inches thick. The spacer 25 and axles 30, 35 and 60, 80 are approximately 1 to ½ inches in diameter, respectively, and 3 inches in length. In the embodiment shown in FIGS. 1 and 2, the opposite ends of the spacer 25 are adhesively attached to the inside surfaces of the two circular plates 14, 20. In the embodiment shown in FIG. 3, the adjustable tension bar 90 is an elongated, flat bar approximately ⅜ inch in diameter.

The length of the support strap 50 must be sufficient so that a branched or non-branched holiday string of lights 5, 5', respectively, are 12 to 20 feet in length maybe wound in a stacked manner around one axle. Also, the width of the support strap 50 must be sufficient so that if the spool 12 is used with a branched string of lights 5, the branch wires 6 and lights 7 are spread across the strap 50 in a flat configuration so that each layer of strap 50 on the axle is relatively thin. In the preferred embodiment, the support strap 50 is made of nylon and measures approximately 3 inches in width and approximately 120 to 240 inches in length.

A means for locking the handles in place on the spool ma also be provided that prevents the axles from unwinding when in storage. In the preferred embodiment, the means for locking is a pivoting lock arm 120 mounted on the outside surface of the circular plate that engages a slot 125 formed on the handle 32, 37 or 65, 85. To lock the axle on the spool, the lock arm 120 is rotated so that the tip of the lock arm engages the slot. To unlock the axle on the spool, the lock arm 120 is rotate so that the tip is disengaged from the slot.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A string of holiday lights and a reduced tangle storage device, comprising:

a. a string of holiday lights;

b. a spool including two parallel plates with a first axle perpendicularly aligned and extended between said plates;

c. a second axle parallel to said first axle;

d. a flexible, elongated support strap extending between said plates and attached at its opposite ends to said first axle and said second axle, said support strap being sufficient in width and length so that when said string of holiday lights is longitudinally aligned and placed adjacent to said support strap and said support strap is wound onto said first axle or second axle, said string of holiday lights is simultaneously wound with said support strap onto said first axle or said second axle thereby preventing layers of said string of holiday lights on said first axle or said second axle from being tangled.

2. A method for storing untangled string holiday lights comprising the following steps:

a. selecting a storage device that includes two parallel circular plates with a first and second axle attached thereto, and a flexible support strap attached to its opposite ends to said first and second axles and wound on said first and second axles in opposite directions, said support strap being sufficient width and length to support a longitudinally aligned string of holiday lights placed adjacent to said support strap as said support strap is wound onto one said axle;

b. selecting a string of holiday lights;

c. inserting the end of said string of holidays lights into a gap formed between the support strap and one said axle when said support strap is wound onto said axle, and;

d. winding said axle with said gap in which said string of holiday lights is extended so that said support strap and said string of holiday lights are wound onto layers onto said axle.

* * * * *